United States Patent [19]

Robbart

[11] Patent Number: 4,554,215

[45] Date of Patent: Nov. 19, 1985

[54] COATING OF CELLULOSIC BASE STOCKS AND THE PRODUCT THEREOF

[76] Inventor: Edward Robbart, 15 Emerson Pl., Boston, Mass. 02115

[21] Appl. No.: 552,316

[22] Filed: Nov. 16, 1983

[51] Int. Cl.[4] ..... B32B 9/04; B32B 9/06; B32B 13/12; B32B 15/04

[52] U.S. Cl. ..... 428/447; 427/255.1; 427/255.6; 427/326; 427/411; 428/448; 428/451; 428/452

[58] Field of Search ..... 427/255.1, 255.2, 255.6, 427/326, 322, 411, 296, 324, 391, 392, 316; 428/447, 448, 451, 452

[56] References Cited

U.S. PATENT DOCUMENTS

| | | | |
|---|---|---|---|
| 3,046,155 | 7/1962 | Reinke | 427/411 |
| 3,856,558 | 12/1974 | Robbart | 427/255.6 X |
| 4,339,479 | 7/1982 | Robbart | 427/255.6 X |

*Primary Examiner*—Michael R. Lusignan
*Attorney, Agent, or Firm*—Jerry Cohen; M. Lawrence Oliverio

[57] ABSTRACT

This invention relates to a method of pretreating cellulosic webs with dry vapors of a lower alkylhalogeno silane, which react with hydroxyl groups in said cellulosic web, and subsequently coating said web. Said invention also relates to the article of manufacture prepared by said method.

19 Claims, No Drawings

COATING OF CELLULOSIC BASE STOCKS AND THE PRODUCT THEREOF

FIELD OF THE INVENTION

This invention relates to improvements in the coating of cellulosic base stocks and to the novel products obtained thereby. More particularly, the present invention is directed to improvements in the coating of webs of cellulosic base stocks by treating the webs with vapors of an organosilicon halide prior to said coating and to the resulting novel products.

BACKGROUND OF THE INVENTION

The development of coated papers has been marked by innovations relating to method and apparatus of applying liquid coatings as a film to a moving web; by the systematic exploration of possible coating formulations; and by the development of various techniques to dry the coating applied.

A crucial consideration in this effort has been the base stock to be coated and here effort has focused on existing techniques for modifying the characteristics of paper to optimize the operation. With the substantial technical advances that have been made in the other areas of coating methodology, at this point it might be observed that base stock preparation is the crucial area needing consideration.

Coatings are applied to paper or paperboard for a wide variety of purposes. For publication grades of paper or paperboard, enhancement of surface appearance is achieved by formuations using a pigment, a binder, and water. Other agents may be added for brightness, enhanced flow properties, and prevention of foam.

For boxboard, multiwall bag, and some other paper grades, a plastic coating such as polyethylene coating is widely employed to provide a measure of release, gloss, water repellency, and inhibition of moisture vapor transmission. Waxes are sometimes employed for similar purposes and to provide rigid-when-wet characteristics for corrugated containers.

Some specialty coatings are silicones, applied as water based emulsions, dissolved in solvents, or 100% solids; coatings of carbonless solution; zinc oxide coatings; and others which serve particular functions such as imparting release, image transfer under pressure, and electrostatic image transfer respectively.

There are an enormous variety of coatings. However, these present very similar problems in terms of base stock requirements. One essential base stock characteristic is evenness of moisture profile. A sheet with uneven moisture content will tend to accept coating unevenly. Another essential base stock characteristic is adequate wet strength. A sheet with insufficient wet strength, will weaken as the web contacts a liquid coating, and may break causing costly downtime and waste. Another essential base stock characteristic is capability of bonding to the coating solution. This bond is a key factor in producing a durable coating. Finally, perhaps the most essential base stock characteristic is holdout to the coating solution. The rate and extent to which the base stock absorbs the coating solution affects pickup of the coating, sheet breaks, drying, speed of operation, and quality of finished product.

The interaction between the base stock and the coating solution is the heart of the coating process. An inadequacy of base stock can sometimes be adjusted through modification of the coating solution, method, or both. The direction of approach in solving these problems is to some degree dependent on whether the fibrous component of the final product is more costly on a weight basis or whether the coating component is the more costly. As the final product will, in most cases be sold by weight, much research and development effort has been focused on enhancement of technique to achieve reduction of fibrous component or coating component without mitigating essential characteristics of the final product.

SUMMARY OF THE INVENTION

The present invention is based on the finding that treating webs of cellulosic base stocks with vapors of silanes to modify the web prior to coating of the web with a coating material normally employed to improve the properties of the web, significantly enhances the coating process. The silane vapor treatment permits minimal usage of coating material while producing uniformity of effect by virtue of diffusion of the vapor across the web wherein it reacts with hydroxyl groups in the cellulose (and with hydroxyl groups of any moisture present) to form a deposit of siloxane and polymers thereof which is chemically bonded to and therefor integral with the cellulosic webs. In particular, it has been found that exposure of cellulosic sheet to vapors of silanes can impart needed hold out, wet strength, release and other characteristics as well as greatly facilitate the subsequent coating operation.

Thus, the process of the invention provides as articles of manufacture cellulosic substrates having a base layer coated on at least one side with a layer of a coating material to improve the properties thereof, said base layer being obtained by treating the cellulosic substrate with vapors of a silane which react with hydroxyl groups in the cellulosic substrate to form a deposit of siloxane and polymers thereof on and integral with the cellulosic substrate.

There are a number of specific benefits derived from treating a web with vapors of the silanes of the invention prior to coating. Treatment allows elimination of costly and less effective sizing agents. Treatment enhances wet strength and inhibits capillary action and thus reduces sheet breaks and downtime during coating. Treatment upgrades and makes uniform the base stock and thus allows greater selection of furnish in making the base stock. Treatment increases holdout to the coating solution and thus enables a reduction in coat weights needed to achieve identical surface characteristics. Treatment reduces moisture absorption by the sheet during coating and thus reduces energy requirements for subsequent drying and allows increased speed of operation. Treatment allows greater versatility in coating formulations as problems of absorption, binder migration and matting are to a degree obviated. Treatment allows greater range in base stock selection as problems of holdout and wet strength are easily remedied.

To generalize, in the case where the fibrous component is the more costly the treatment may be used to allow use of lighter weight base stocks, or stock which is cheaper to produce or finish, and which is then upgraded by the treatment. In the case where the coating component is the more costly, treatment may be used to reduce the amount of coating by holding it to the surface, and may thereby further reduce drying requirements and enable faster processing.

The specific benefits conferred will vary with the specific coating operation. In every case a base stock more suitable for coating is produced by the invention.

DETAILED DESCRIPTION OF THE INVENTION

The treatment of the webs of cellulosic base stocks with vapors of silanes can be effected, for example, by using the process described in U.S. Pat. No. 3,856,558 and U.S. Pat. No. 4,399,479, both of which are hereby incorporated by reference. According to these processes cellulosic materials having a moisture content of below 10% by weight, preferably below 7% by weight are contacted with the organosilicon halide. Cellulose materials having moisture contents in excess of 7% may be heated to remove surface moisture. Alternatively, such materials may first be frozen in accordance with the teachings of U.S. Pat. No. 4,339,479. A moisture content of up to about 7 weight percent in the cellulosic material is preferred in those instances wherein the cellulosic material is not contacted in its cold or frozen state.

The contact time of the cellulosic material and the organosilicon halide is in all cases sufficient to effect siloxane formation and will vary depending upon the temperature of the cellulosic material and organosilicon halide vapor, the concentration of the organosilicon halide in the contacting atmosphere, the pressure within the reaction zone and the moisture content of the cellulosic material. Contact times ranging from 0.1 second up to 2 have been utilized successfully.

The temperature of the organosilicon halide is sufficiently high to effect reaction between the organosilicon halide and hydroxyl groups on the cellulosic material and any moisture present to form siloxane and/or polysiloxane within the claimed contact time but not so high as to degrade the cellulose at the contact time employed. Suitable temperatures range from 50° F., to about 200° F.

Generally, when employing higher temperatures, shorter contact times are employed and conversely, when employing relatively low temperatures, longer contact times can be employed. Furthermore, the concentration of the organosilicon halide in the atmosphere through which the cellulosic material is passed can be varied up to the saturation level of the atmosphere for the organosilicon halide and, if employed, a solvent for the organosilicon halide. The concentration of the organosilicon halide can range up to the saturation level of the atmosphere but should not be so low as to require excessive contact times in order to effect the desired reaction and to render the cellulosic material water-repellent. Typically, the concentration of the organosilicon halide ranges from about 2% volume percent up to the saturation level of the atmosphere within the reacton zone.

The reaction zone is normally maintained under a slight negative pressure during the treating operation but the pressure therein can vary widely say from as low as 1 Torr up to about 760 Torr.

When a cellulosic material having a moisture content of below 2 weight percent is employed pursuant to one aspect of the present invention the contact time must be increased and the variables of organosilicon halide vapor temperature, concentration, and the contact chamber pressure are maintained so that the final pH of the cellulosic material rendered water-repellent does not fall below 2.5 and preferably not below 3.5. The range of conditions which will ordinarily be employed will fall in the following ranges:

Temperature of organosilicon halide: 50° F. to 200° F.

Temperature of cellulosic material: frozen to 200° F.

Concentration of organosilicon halide: 2% to saturation

Again, within the ranges set forth conditions are selected and maintained so that the final pH of the cellulosic material does not fall below 2.5.

The suitable silanes useful in this process are those commonly employed in water repellency treatments for cellulosic materials. Suitable silanes include organosilicon halides and organoalkoxysilanes.

Illustration of organoalkoxysilanes which can be used are lower alkyl alkoxysilanes such as lower alkyl mono-, di- and tri- alkoxys silanes and mixtures thereof. Specific examples of lower alkyl alkoxylsilanes are methyl trimethyloxysilane, dimethyl dimethyloxysilane, ethyl trimethyloxysilane, trimethyl ethoxysilane, etc. Useful organosilicon halides are described by Patnode in U.S. Pat. No. 2,306,222, Norton, U.S. Pat. No. 2,412,470, and in my earlier U.S. Pat. Nos. 2,782,090, 2,824,778 and 2,961,338 which are incorporated herein by reference. Particularly suitable organosilicon halides are the lower alkyl silicon halides such as methylchlorosilanes, ethylchlorosilanes, butylchlorosilanes and propylchlorosilanes. Typically, however the silicon halides will be a mixture of dimethyldichlorosilane, $(CH_3)_2SiCl_2$; methyldichlorosilane, $CH_3SiHCl_2$' and methyltrichlorosilane, $CH_3SiCl_3$ which may contain silicon tetrachloride, $SiCl_4$.

The cellulosic material may be contacted with the vaporized organosilicon halide alone or together with a vaporized solvent for the organosilicon halide which solvent is inert both to the organosilicon halide and the paper being treated. It has been found that the presence of the solvent during the treatment step results in the formation of a treated cellulosic material having a higher pH as compared with a cellulosic material which is treated with the same organosilicon halide without the solvent under equivalent reaction conditions. Representative suitable solvents include toluene, xylene, hexane, perchloroethylene, fluorinated hydrocarbons, or other non-reactive solvents in which the organosilicon halide may be dissolved. It has been found that as little as 10 mole percent solvent is effective but that larger concentrations of the solvents in the range of about 12 to 100 mole percent based upon the total mole of the organosilicon halide and solvent are preferred. A molar quantity ten times or more that of the organosilicon halide is effective. If desired, higher concentrations of the solvent can be employed. However, the presence of excessive concentrations of solvent effects a reduction of reaction rate and increases the expense of the solvent without a significant beneficial effect.

The silane vapors or the mixtures of silane vapors in solvent may be formed by bubbling air through the liquid silane or an admixture of the silane and solvent or more simply by dropping the liquid of the desired composition slowly onto a hot plate to generate vapors of the same molar composition as the liquid. Alternatively, an aerosol mixture may be employed as described in my U.S. Pat. No. 2,824,778 which is incorporated herein by reference. When employing a solvent having a significantly different vapor pressure than the silane and when effecting vaporization by bubbling air, it is preferred that the solvent and silane be maintained as separate liquids in order to better control the composition of the vapors formed in the treating chamber.

The air to be mixed with the silane in the treatment step should contain as little water as possible to avoid significant reaction of water in the air with the silane which results in the formation of by products such as hydrogen halide and reduction of the amount of silane that can react with the cellulosic material.

In instances where the moisture content of the cellulosic material to be treated is greater than about 10 weight percent, it may be desirable to subject the cellulosic material to a drying step prior to the treatment with organosilicon halide. The drying step need only be conducted at a temperature and a time sufficient to remove part of the surface moisture from the material while retaining at least about 2 weight percent moisture in the material. Heating to about 250° F. for from about 3 to 5 seconds is sufficient in most cases. The desirability or necessity of this step will depend upon such factors as the prevailing humidity on the day of treatment, the uptake of moisture by the material during manufacture and storage and the conditions of treatment. If desired, the cellulosic material treated with silane, either in the presence of or in the absence of a solvent, is further treated, upon removal from the silane treating step, to remove undesirable by-product such as hydrogen halide gas formed during the reaction prior to a substantial portion of it becoming dissolved by moisture in the cellulosic material. Generally, by product gas removal such as hydrogen halide gas removal can be effected by heating the cellulosic material, by applying suction to the cellulosic material or by passing the treated cellulosic material into contact with a moving stream of air.

Illustrative cellulosic base stocks treated pursuant to the present invention are cellulosic substrates such as paper of various grades, paperboard, wallboard, wood, textiles and the like.

The invention can be used to improve all coating processes wherein webs of cellulosic base stocks are coated with various coating materials to improve properties of the substrate such as surface characteristics, (e.g. brightness, gloss, pigmentation, smoothness, opacity, evenness of moisture profile, release, etc.), wet strength, water-repellency, adhesives, flame-retardation, image transfer under pressure, electrostatic image transfer, inhibition of moisture vapor transmission and the like. The various coating materials and formulations utilized to improve properties of cellulosic substrates such as those exemplified above are well known to those skilled in the art and need not be enumerated herein. See, for example, Looner, Joseph T., "Coated Papers", *Handbook of Pulp and Paper Technology*, Kenneth W. Britt, 1970, hereby incorporated by reference. Several illustrations of such coating materials and processes are given in the working examples below.

Conventional methods are employed for applying various coating materials to the cellulosic substrates and include flowing, spraying, dip coating, skin coating, spin coating, roll-type coating such as nip roll coating, reverse roll coating, trailing blade coating, etc., depending principally upon the substrate being coated.

The following examples are included to further illustrate the present invention.

EXAMPLE I

A sheet of bleached supercalendered Kraft paper, having a basis weight of 40 lbs. and a moisture content of 5% by weight is treated with vapors of methyldichlorosilanes at room temperature and atmospheric pressure for 5 seconds. The sheet is then coated with a commercial silicone release formulation at a coat weight roughly 20% of that normally required or about 0.12 lbs. per ream. The sheet is then cured in an oven at 300° F. for 60 seconds.

Subsequent testing with adhesives indicates the sheet has free release characteristics and is in every other way suitable for the same purposes a sheet with a higher weight of silicone coating would serve. In addition the sheet has superior bond to the coating.

EXAMPLE II

A sheet of machine glazed Kraft paper having a basis weight of 30 lbs. and a moisture content of 5% is exposed to vapors of the methyldichlorosilanes of Example I as described therein and then coated with a commercial silicone at a coat weight roughly corresponding to 0.5 lbs per ream and then cured as in Example I. The sheet is found to have abhesive characteristics normally found on silicone-coated bleached supercalendered Kraft paper and for which far more expensive base stock with its enhanced holdout is required. For applications where evenness of caliper is not required, treatment appears to allow use of this far less expensive base stock.

The following example shows benefits of treatment in a continuous operation with a costly coating solution.

EXAMPLE III

A roll of fine paper having a basis weight of 20 lbs. and a moisture content of 5% by weight is exposed to vapors of a mixture of silanes comprised of 95% methyltrichlorosilanes, and 5% methyldichlorosilanes by weight. The exposure takes place on a continuous basis using a treating apparatus described in pending U.S. application Ser. No. 445,011 to Edward Robbart filed Nov. 19, 1982, hereby incorporated by reference. The sheet of paper enters the treating apparatus at a rate of 300 feet per minute so that the contact time is approximately 0.4 seconds. The treating unit is maintained at a slight negative pressure by the pull of an exhaust fan. The roll is subsequently coated with a commercial carbonless solution at a coat weight approximately 50% of that normally used. The solution is held to the surface of the web and copies made from the resulting paper are as clear a copies made on untreated sheets with heavier coating weights. The use of reduced coat weight allows faster operation as less drying is required.

EXAMPLE IV

A roll of newsprint having a basis weight of 30 lbs. and a moisture content of 4% is exposed to vapors of methyltrichlorosilanes on a continuous basis using the process and apparatus described in Example III. The roll is subsequently run through a blade coater at 2000 feet per minute and a coating of clay and starch applied. Breaks and other difficulties at high speed operation with this grade are not encountered. The finished product is found suitable as a publication grade.

EXAMPLE V

A roll of bleached board having a basis weight of 60 lbs. and a moisture content of 3.5% is exposed to vapors of 60% methyltrichlorosilanes, and 40% dimethyldichlorosilanes by weight. The exposure takes place on a continuous basis using the process and apparatus described in Example III. One side of the roll is subsequently coated with a 1 mil polyolefin, e.g. polyethylene, coating by extrusion. The roll is found suitable for foodboard applications normally requiring two-sided polyethylene coating. The release, water repellency and inhibition of capillary action conferred by the silanes enhance one side, while the gloss and moisture vapor block from the polyethylene make the board as a whole suitable.

It is claimed:

1. In a method of coating webs of cellulosic base stocks wherein a coating material is applied to the web of the base stock so as to improve the properties thereof, the improvement comprising, prior to said coating, treating said web with dry vapors of a lower alkyl-halogeno silane which react with hydroxyl groups in the cellulosic base stock to form a deposit of siloxane and polymers thereof on and integral with said web of cellulosic base stock, and forming a deposit of said coating material on said deposit of siloxane and polymers thereof.

2. A method according to claim 1 wherein the cellulosic base stock is paper.

3. A method according to claim 2 wherein said coating material is a paper sizing agent.

4. A method according to claim 2 wherein said coating material is an adhesive.

5. A method according to claim 2 wherein said coating material is a release agent.

6. A method according to claim 2 wherein said coating material is a carbonless solution.

7. A method according to claim 2 wherein the coating material is a synthetic plastic.

8. A method according to claim 6 wherein the synthetic plastic is a polyolefin.

9. A method according to claim 7 wherein the polyolefin is polyethylene.

10. In an article of manufacture wherein at least one side of a cellulosic substrate has applied thereto a layer of a coating material to improve the properties thereof, the improvement comprising a base layer for said coating material, said base layer being obtained by treating the cellulosic substrate with dry vapors of a lower alkyl-halogeno silane which react with hydroxyl groups in the cellulosic substrate to form a deposit of siloxane and polymers thereof on and integral with said cellulosic substrate, and forming a deposit of said coating material on said deposit of siloxane and polymers thereof.

11. An article of manufacture according to claim 10 wherein the cellulosic base stock is paper.

12. An article of manufacture according to claim 10 wherein the coating material is a paper sizing agent.

13. An article of manufacture according to claim 10 wherein said coating material is an adhesive.

14. An article of manufacture according to claim 10 wherein said coating material is a release agent.

15. An article of manufacture according to claim 10 wherein said coating material is a carbonless solution.

16. An article of manufacture according to claim 10 wherein the coating material is a synthetic plastic.

17. An article of manufacture according to claim 16 wherein the synthetic plastic is a polyolefin.

18. An article of manufacture according to claim 17 wherein the polyolefin is polyethylene.

19. An article of manufacture according to claim 10 wherein both surfaces of the paper are silane treated to provide said base layer and then one surface of the silane-treated paper is coated with polyethylene.

* * * * *